US008397510B2

(12) United States Patent
Dodo et al.

(10) Patent No.: US 8,397,510 B2
(45) Date of Patent: Mar. 19, 2013

(54) COMBUSTOR FOR GAS TURBINE

(75) Inventors: Satoshi Dodo, Kasama (JP); Susumu Nakano, Hitachi (JP); Kuniyoshi Tsubouchi, Mito (JP); Shohei Yoshida, Hitachiota (JP); Yoshitaka Hirata, Tokai (JP)

(73) Assignee: Hitachi, Ltd., Tokyo (JP)

( * ) Notice: Subject to any disclaimer, the term of this patent is extended or adjusted under 35 U.S.C. 154(b) by 1138 days.

(21) Appl. No.: 10/582,954

(22) PCT Filed: Dec. 16, 2003

(86) PCT No.: PCT/JP03/16120

§ 371 (c)(1),
(2), (4) Date: Jul. 2, 2007

(87) PCT Pub. No.: WO2005/059442

PCT Pub. Date: Jun. 30, 2005

(65) Prior Publication Data

US 2007/0256416 A1 Nov. 8, 2007

(51) Int. Cl.
*F02C 1/00* (2006.01)

(52) U.S. Cl. ..... 60/737; 60/733

(58) Field of Classification Search ..... 60/733, 60/737, 740, 742, 746, 747; 431/9, 115, 431/177

See application file for complete search history.

(56) References Cited

U.S. PATENT DOCUMENTS

| | | | | |
|---|---|---|---|---|
| 2,930,192 | A * | 3/1960 | Johnson | 60/746 |
| 5,850,732 | A * | 12/1998 | Willis et al. | 60/804 |
| 6,745,558 | B2 * | 6/2004 | Murakami et al. | 60/39.281 |

FOREIGN PATENT DOCUMENTS

| | | |
|---|---|---|
| JP | 53-143816 | 12/1978 |
| JP | 57-041524 | 3/1982 |
| JP | 59-163762 | 11/1984 |
| JP | 2-309123 | 12/1990 |
| JP | 3-207917 | 9/1991 |
| JP | 5-172331 | 7/1993 |
| JP | 7-019482 | 1/1995 |
| JP | 7-233945 | 9/1995 |
| JP | 2000-199626 | 7/2000 |
| JP | 2002-257344 | 9/2002 |

* cited by examiner

*Primary Examiner* — Phutthiwat Wongwian
(74) *Attorney, Agent, or Firm* — Brundidge & Stanger, P.C.

(57) ABSTRACT

A combustor for a gas turbine capable of performing stable combustion even by using high temperature air, comprising a first burner (5) jetting fuel and air into a combustion chamber (2) and a second burner (8) causing the circulating jet of the fuel and air installed at a position corresponding to the tip part of a flame caused by the first burner (5).

4 Claims, 6 Drawing Sheets

COMBUSTOR FOR GAS TURBINE

TECHNICAL FIELD

The present invention relates to a combustor for a gas turbine, and more particularly to a combustor for a gas turbine which is preferable in the case that an air temperature in an inlet of the combustor is high.

BACKGROUND ART

Conventionally, a combustor for a gas turbine which can execute a stable combustion even if an air temperature in an inlet of the combustor is high has been proposed, for example, as disclosed in JP-A-2003-257344.

In accordance with the combustor for the gas turbine described in the prior art mentioned above, it is possible to slowly execute the combustion. As a result, it is possible to execute a stable combustion even if the air having a high temperature is used.

However, in the combustor for the gas turbine in accordance with the prior art mentioned above, since an injecting direction of a fuel and an air by a pilot burner is approximately in parallel to an injecting direction of a fuel and an air by a burner for a slow combustion, a combustion gas of the pilot burner and an air-fuel mixture of the burner for the slow combustion flow in parallel and a mixture thereof is slow. As a result, it is hard to execute the stable combustion.

An object of the present invention is to provide a combustor for a gas turbine which can execute a stable combustion even if an air having a high temperature is used.

DISCLOSURE OF THE INVENTION

In order to achieve the object mentioned above, in accordance with the present invention, there is provided a combustor for a gas turbine, comprising:

a first burner injecting a fuel and an air into a combustion chamber; and a second burner generating a circulation jet flow of the fuel and the air at a position corresponding to a leading end portion of a frame generated by the first burner.

As mentioned above, in accordance with the present invention, since the second burner is provided at the position corresponding to the leading end portion of the frame generated by the first burner, the air-fuel mixture of the fuel and the air generated by the second burner is brought into contact with the combustion gas generated by the first burner in a wide contact area, and is mixed by a strong turbulence caused by the jet flow collision. As a result, even if the air temperature in the inlet side of the combustor is high, it is possible to execute a slow combustion which does not locally generate a high-temperature region within the combustor, and it is possible to execute a stable combustion without generating a back fire or a self-fire.

BEST MODE FOR CARRYING OUT THE INVENTION

Figure 1:
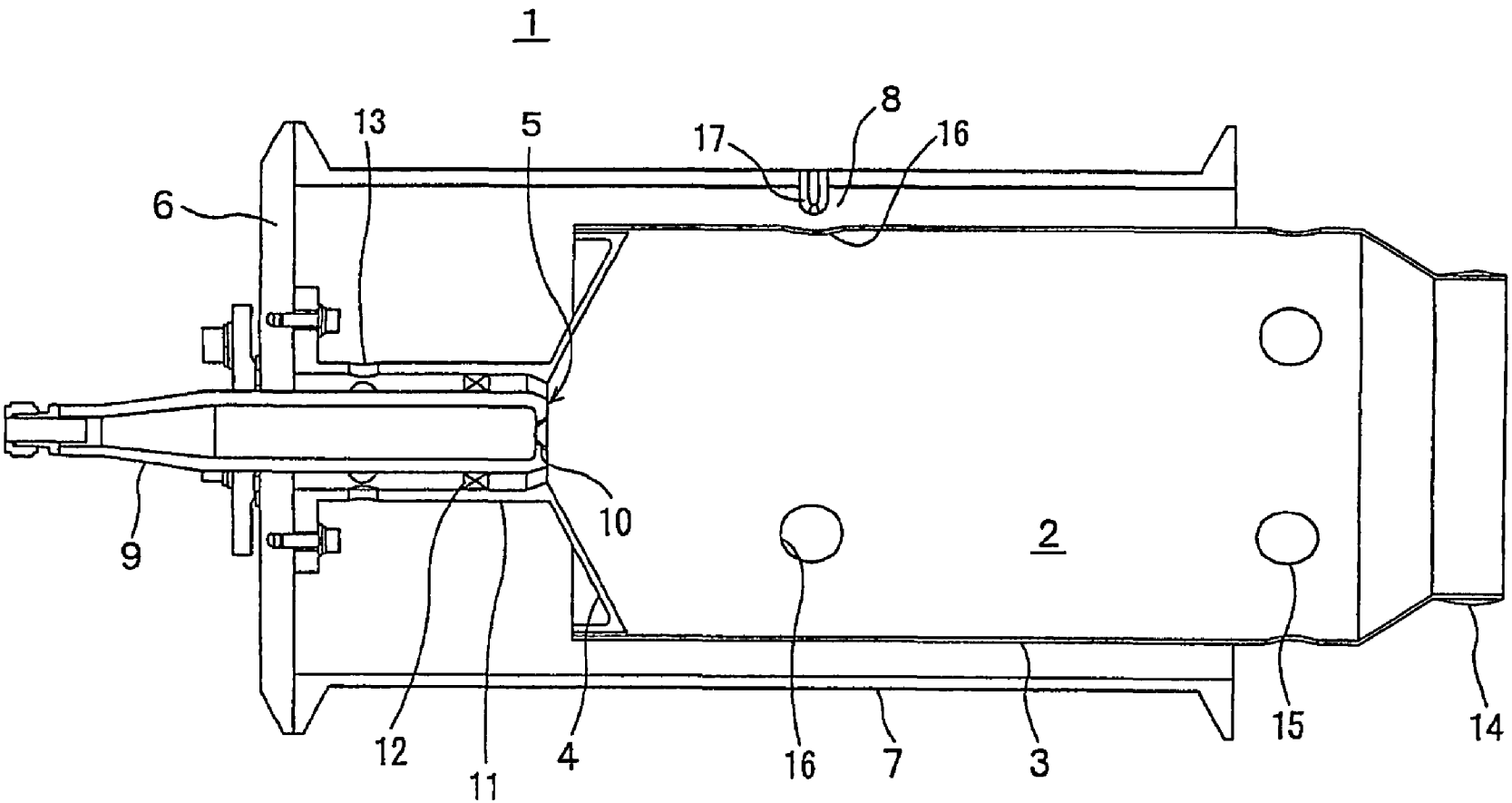
FIG. 1 is a vertical cross sectional side elevational view showing a first embodiment of a combustor for a gas turbine in accordance with the present invention.

A description will be given below of a first embodiment of a combustor for a gas turbine in accordance with the present invention, on the basis of a combustor for a back flow can type regeneration type gas turbine shown in FIG. 1. The present embodiment corresponds to a combustor having a specification that an air temperature in an inlet of the combustor is 659° C., an average gas temperature in an outlet cross section of the combustor is 980° C., and a city gas "13A" is used as a fuel, and used for a gas turbine which executes a comparatively small capacity of power generation and is preferable for a regeneration type gas turbine power generation equipment having a narrow load operation range. Further, Table 1 shows a combustion gas average flow speed in an outlet cross section of the combustor, an equivalent ratio in a whole of the combustor and an allocation of the air and the fuel in the present embodiment.

TABLE 1

| No. | item | unit | numerical value |
|---|---|---|---|
| 1 | outlet average flow speed | m/s | 28.0 |
| 2 | combustor whole equivalent ratio | — | 0.135 |
| 3 | combustor inlet air temperature | ° C. | 659 |
| 4 | combustor liner opening area rate | % | 21 |
| 5 | primary air ratio | % | 8 |
| 6 | secondary air ratio | % | 25 |
| 7 | cooling air ratio | % | 30 |
| 8 | dilution air ratio | % | 37 |
| 9 | primary fuel ratio | % | 24 |
| 10 | secondary fuel ratio | % | 76 |
| 11 | pilot burner equivalent ratio | — | 0.392 |
| 12 | secondary burner equivalent ratio | — | 0.410 |
| 13 | pilot burner combustion gas temperature | ° C. | 1152 |
| 14 | secondary burner combustion gas temperature | ° C. | 1466 |
| 15 | secondary burner mixture average temperature | ° C. | 866 |

A combustor 1 in accordance with the present embodiment has a tubular combustor liner 3 forming a combustion chamber 2 and having a circular cross sectional shape, a liner cap 4 closing an upstream side of the combustor liner 3, a first burner 5 formed in a center of the liner cap 4 and constituted by a pilot burner, an end cover 6 provided in an upstream side of the first burner 5, an outer tube 7 in which one end side is fixed to the end cover 6 and the other end side is provided in an extending manner in an outer peripheral portion side of the combustor liner 3 via a gap, and a plurality of second burners 8 formed so as to pass through a peripheral wall of the combustor liner 3.

The first burner 5 bears an operation from an ignition of the combustor 1 to a start and warm-up and a partial load operation, for example, to 80%. The first burner 5 is coaxially formed with the combustor liner 3, and has a first fuel nozzle 9 in which a downstream end is positioned in the center of the liner cap 4 and an upstream end is provided in an extending manner so as to pass through a center portion of the end cover, in a center portion of the first burner 5. A first fuel spray hole 10 is provided in a downstream end of the first fuel nozzle 9, an air introduction tube 11 coaxial with the first fuel nozzle 9 is formed in an outer periphery of the first fuel nozzle 9 via a gap, and a swirling vane 12 is provided in this gap. A downstream side of the air introduction tube 11 is open to an inner side of the combustor liner 3 from the liner cap 4, and an upstream side thereof is closed by the end cover 6. Further, a first air introduction hole 13 is provided close to the end cover 6 side of the air introduction tube 11.

The downstream side of the combustor liner 3 is coupled to a transition piece (not shown) via an elastic seal member 14. Further, a dilution hole 15 for introducing the heated air for smoothening a gas temperature distribution in an outlet side is provided in the downstream side of the combustor liner 3, for example, at six positions in a peripheral direction. In addition, actually, there are provided a stopper fixing the position to the combustor liner 3, and a film cooling slot for securing a reliability, however, an illustration is omitted because a complication is generated.

A plurality of second burners 8 are constituted by a second air introduction hole 16 provided in a peripheral wall of the combustor liner 3, and a second fuel nozzle 17 provided so as to pass through a peripheral wall of the outer tube 7 facing to the second air introduction hole 16. The second burners 8 are positioned close to the first burner 5, and are provided, for example, at three positions in the peripheral direction.

In the combustor 1 having the structure mentioned above, a combustion air is compressed by a compressor (not shown), and is guided in a left direction in the drawing from a gap between the combustor liner 3 in a right side in the drawing and the outer tube 7, in a state of being heated by a regeneration heat exchanger (not shown). A part of the guided combustion air is introduced to the combustion chamber 2 within the combustor liner 3 through the diluting hole 15 and the second air introduction hole 16, and the rest is sprayed into the combustion chamber 2 from the liner cap after entering into the air introduction tube 11 from the first air introduction hole 13 and being applied a swirling force by the swirling vane 12. The combustion gas after entering into the combustion chamber 2 and contributing to the combustion flows out to the transition piece. In this case, since the air having a high temperature and a high pressure which enters into the air introduction tube 11 from the first air introduction hole 13 and is applied the swirling force by the swirling vane 12 enters into the combustion chamber 2 and is rapidly expanded, it forms a circulation flow region in a downstream side of the first fuel nozzle 9.

Further, the fuel is injected into the combustion chamber 2 from the first fuel nozzle 9 and the second fuel nozzle 17, and the fuel from the first fuel nozzle 9 is injected to the circulation flow region of the previously injected air. Including the fuel from the first fuel nozzle 9, the fuel injected into the combustion chamber 2 is mixed with the previous combustion air so as to form a diluted air-fuel mixture and is burned. Since the fuel is not mixed with the air outside the combustion chamber, a self-fire and a back fire are not generated.

In this case, since the pilot burner 5 has an influence of a combustion stability of an entire of the combustor and is used in a wide range from the ignition start to the 80% partial load, the pilot burner 5 is structured as a diffusion combustion type burner in the present embodiment. Particularly, in the case that it is necessary to suppress a discharge amount of a nitrogen oxide (hereinafter, refer to as NOx), it is effective to form the first fuel injection hole 10 of the first fuel nozzle 9 by a lot of small holes. Further, in the case that a combustion performance forming a low NOx is required, it is effective that the first fuel injection hole 10 is provided near an outlet of the air introduction tube 11 in addition to the leading end of the first fuel nozzle 9, thereby promoting the mixing between the fuel and the air. In this case, if all of the first fuel injection holes 10 are provided in the outlet of the air introduction tube 11, an ignition performance and a blow-off resisting performance are deteriorated. Accordingly, it is preferable to limit a number of the first fuel injection hole 10 provided near the outlet of the air introduction tube 11 to about one half of the whole.

On the other hand, the fuel is injected radially to the air sprayed into the combustion chamber 2 from the secondary air introduction hole 16, from a second fuel nozzle 17 installed in the same position. In this case, in the fuel just after being injected from the second fuel nozzle 17, since the flow speed of the air injected from the second air introduction hole 16 is large, and a shear with respect to the combustion gas in the periphery is strong, the frame blows off immediately after the combustion reaction is started. As a result, since the frame is not held near the second fuel nozzle 17, and the local high-temperature region does not appear in the wall surface of the combustor liner 3 in the vicinity of the second fuel nozzle 17, it is advantageous in view of securing a reliability. Further, the air sprayed from the second air introduction holes 16 at three positions in the peripheral direction comes into collision with each other near the center portion of the combustion gas combustor liner 3 from the pilot burner 5 so as to form a stagnation region, and form a circulation flow region in each of an upstream side and a downstream side of the second air introduction hole 16. Since the air flow speed is lowered within the circulation flow region, and there is formed a condition that a propagated frame can be sufficiently maintained, the fuel sprayed from the second fuel nozzle 17 starts the combustion reaction within the circulation flow. At this time, since the fuel and the air form the diluted air-fuel mixture having an equivalent ratio of 0.41 at a time point of starting the reaction, it is possible to adopt a reaction aspect which is rate controlled by a slow oxidizing reaction depending on the heat diffusion to the air-fuel mixture, and it is possible to achieve a low NOx combustion which does not generate a local high-temperature portion. At this time, since the mixed gas between the air introduced from the second air introduction hole 16 and the fuel injected from the second fuel nozzle 17 is contacted and mixed with the combustion gas of the frame by the pilot burner 5 at a wide contact area, by utilizing the large turbulence generated by the stagnation caused by the collision of the air jet flow introduced from the second air introduction hole 16, on the basis of the installed positions of the second air introduction hole 16 and the second fuel nozzle 17 being faced to the portion near the leading end portion of the frame generated by the pilot burner 5, it is possible to obtain a quick mixing effect.

Next, a description will be given of a result obtained by applying a chemical reaction simulation to the slow combustion reaction of the diluted air-fuel mixture mentioned above with reference to FIG. 2. In FIG. 2, a horizontal axis corresponds to a distance from the second air introduction hole to the dilution hole 15 standardized by an entire length of the combustor liner 3. A position of the diluting hole 15 exists at 0.668 in the combustor 1 shown in FIG. 1. In FIG. 2, a lower curve shows a change of a combustion gas temperature along a combustion gas circulating direction within the combustor, and an upper curve shows a concentration of a monoxide along the combustion gas circulating direction as an index of the reaction.

The diluted air-fuel mixture formed by the fuel and the air from the second burner 8 and having an equivalent ratio of 0.41 is mixed with the combustion gas at 1152° C. from the pilot burner 5 in the stagnation region near the center portion in the diametrical direction of the combustor liner 3 so as to form a diluted air-fuel mixture having a mixing average temperature of 866° C. The diluted air-fuel mixture generates heat step by step so as to be increased in temperature while the fuel is slowly oxidized so as to generate the carbon monoxide, and the heat generation is rapidly executed after the concentration of the carbon monoxide reaches the maximum value and the concentration of the carbon monoxide is lowered. A necessary staying time is about 30 ms in the case that the air-fuel mixture average temperature of the combustor 1 shown in FIG. 1 is 866° C., and in order to secure 35 ms for suppressing an unburned emission material, the position of the diluting hole 15 is placed in a downstream of the second air introduction hole 16.

Figure 3:
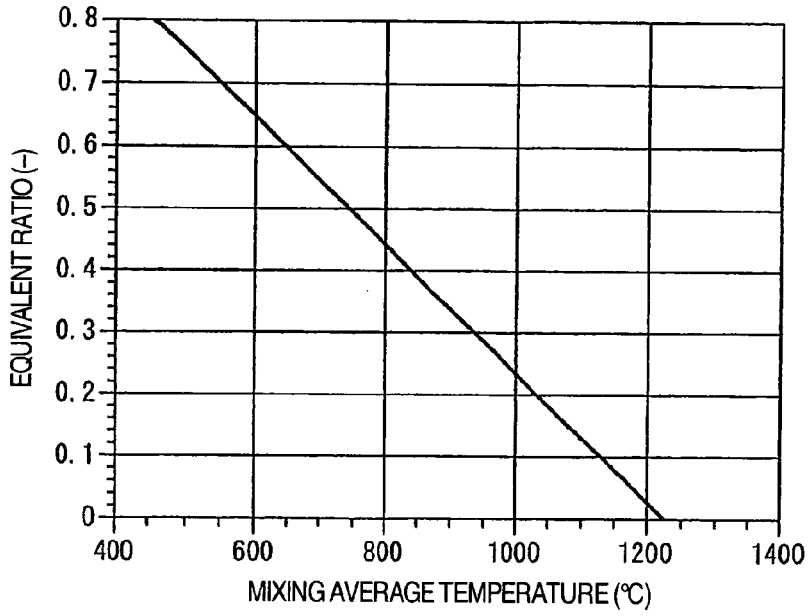
FIG. 3 is a graph showing a relation between an equivalent ratio and a mixing average temperature in a secondary combustion region of the combustor for the gas turbine shown in FIG. 1.

FIG. 3 shows a condition that a high fuel efficiency equal to or more than 99% can be obtained, with respect to an equivalent ratio defined by the fuel and the air from the second burner 8, and a mixing average temperature of the fuel and the air from the second burner 8 and the combustion gas from the pilot burner 5, in the case that the staying time of the region (the secondary combustion region) from the second air introduction hole 16 to the diluting hole 15. The high combustion efficiency can be secured in the case of a right upper condition of an approximated line shown in FIG. 3, that is, a condition $\phi \geqq 0.001034567 + Tmix + 1.27181$ with respect to the mixing average temperature Tmix and the equivalent ratio $\phi$, however, in the case that the mixing average temperature is made too high, or the equivalent ratio is made too large, the reaction quickly progresses and the discharge amount of the nitrogen oxide is increased. Further, the high combustion efficiency can be obtained in the leaner equivalent ratio than the condition mentioned above shown in FIG. 3, by setting the staying time long, however, the length of the combustor 1 is increased.

In the combustor 1 in accordance with the present embodiment, in order to prevent the fuel supplied from the second fuel nozzle 17 from being diffusion burned just after being injected, it is important for achieving the low NOx combustion performance to secure the spray flow speed of the air from the second air introduction hole 16 equal to or more than 50 m/s. Further, it is important in view of securing the combustion stability that the jet flow of the air from the second introduction hole 16 reaches the center portion in the diametrical direction of the combustor liner 3 in the leading end portion of the combustion gas (the flame) generated by the pilot burner 5, comes into collision with each other so as to form the stagnation region and forms the circulation flow region in the upstream side and the downstream side.

In order to spray the air from the second air introduction hole 16 to the center portion in the diametrical direction of the combustion liner 3, it is proper to design a flow speed of the air from the second air introduction hole 16 with respect to the average air flow speed defined by the cross section of the combustor liner 3 equal to or more than about three times, and it is desirable to design a rate of an opening portion area with respect to a surface area of the combustor liner 3 to 20 to 30%, and a total pressure loss coefficient of the combustor 1 to 40 to 50.

Figure 2:
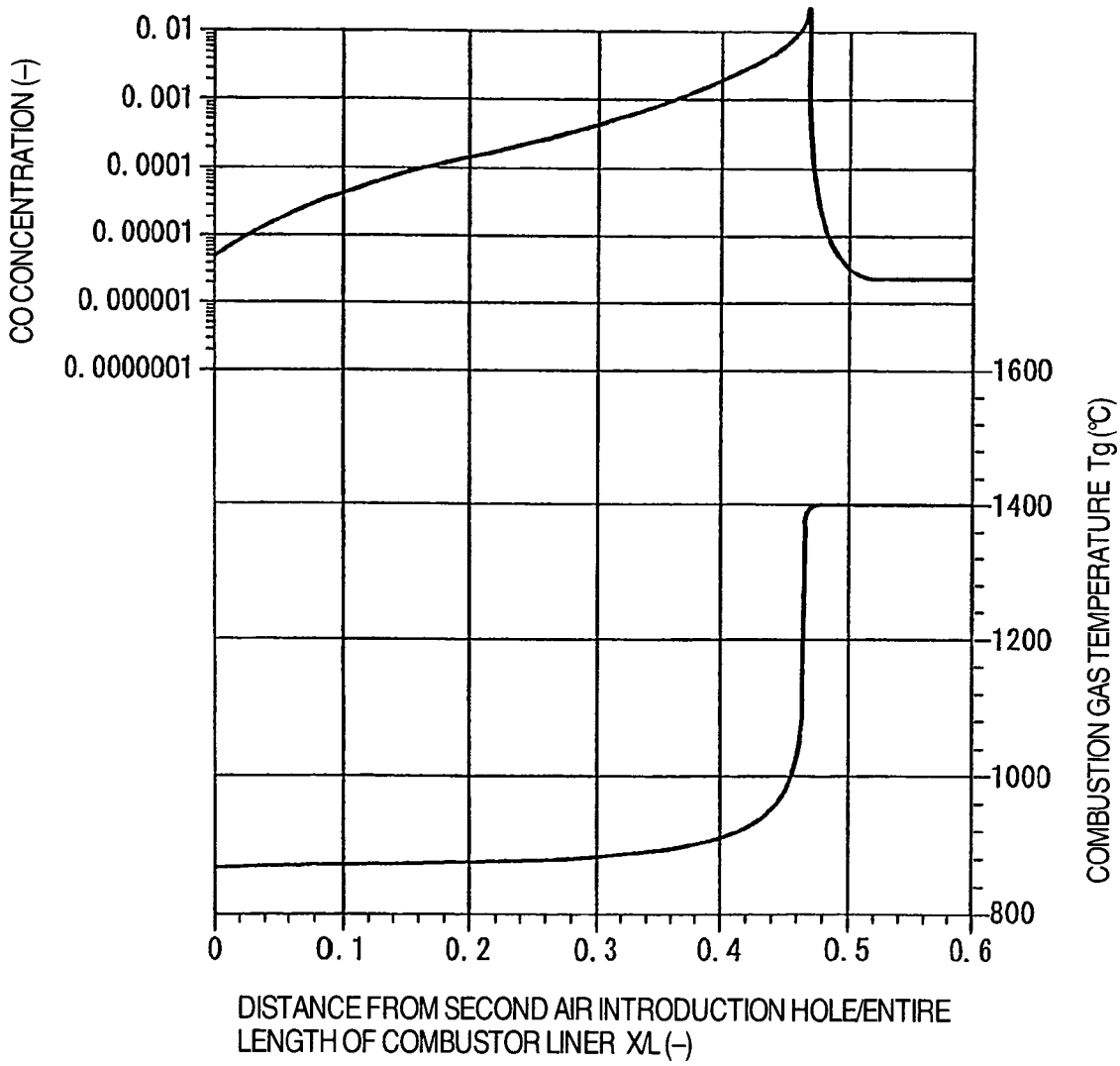
FIG. 2 is a graph showing a change by a reaction calculation of a carbon monoxide concentration and a combustion gas temperature in the combustor for the gas turbine shown in FIG. 1.

In the embodiment shown in FIG. 1, the opening area ratio rate is 21.04%, the total pressure loss coefficient is 44.6, and the spray flow speed of the air from the second air introduction hole 16 is 69.2 m/s. In this case, since it is necessary to take into consideration the limit of the pressure loss allowable in the combustor 1, for selecting the opening area rate and the total pressure loss coefficient, it is impossible to unconditionally determine an optimum value. As the spray flow speed of the air from the second air introduction hole 16, taking into consideration the high temperature due to the pre-heat and the increase of the combustion speed due to the turbulence, 50 to 70 m/s is proper.

Since the injection flow speed of the fuel radially injected from the second fuel nozzle 17 is large as mentioned above, the fuel is not burned immediately, but is mixed with the air from the second air introduction hole 16 during the time when the fuel reaches the stagnation region near the center portion in the diametrical direction of the combustor liner 3 so as to form the air-fuel mixture. At this time, if the injection angle of the combustion is too small, the fuel is concentrated to one position and is not mixed with the air. As a result, since there is generated the diffusion combustion that the fuel reaches the circulation flow region near the air stagnation region near the center portion in the diametrical direction of the combustor liner 3 and is thereafter burned, a local high-temperature portion is generated, and NOx having a high concentration is discharged. Accordingly, in the present embodiment, it is important for achieving the low NOx combustion performance to properly select the injection angle of the second fuel nozzle 17.

Figure 4:
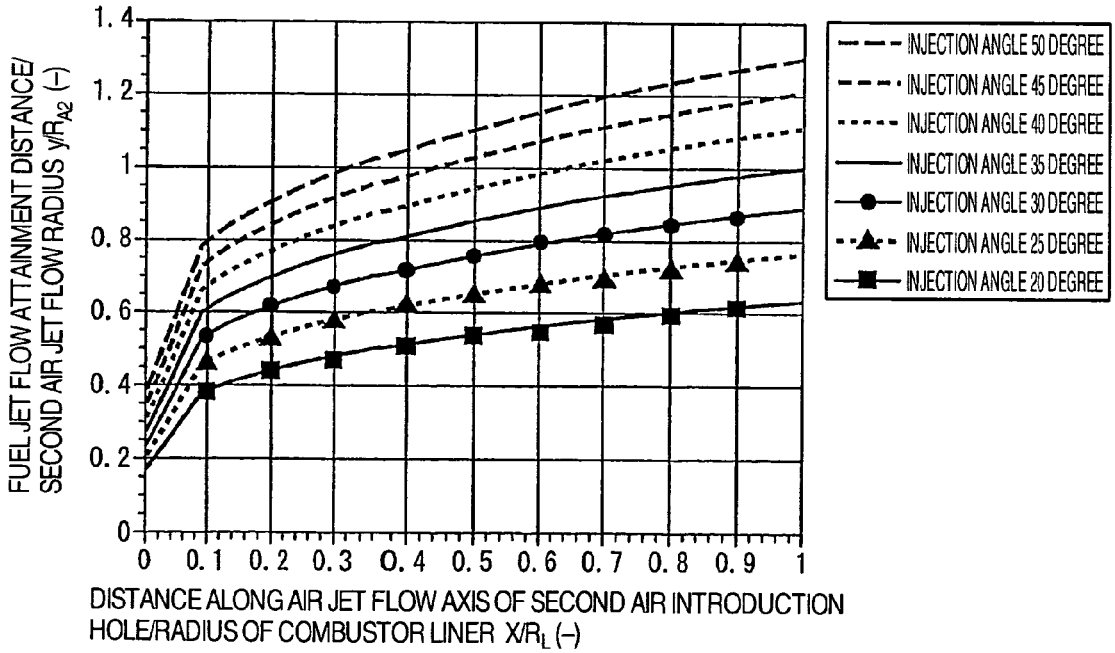
FIG. 4 is a graph showing a relation between an attainment distance and a spray angle of a fuel from a second fuel nozzle in the secondary combustion region of the combustor for the gas turbine shown in FIG. 1.

Then, FIG. 4 shows a result obtained by considering a fuel attainment distance in the air jet from the second air introduction hole 16, with respect to the injection angle of the second fuel nozzle 17. A horizontal axis corresponds to a value obtained by standardizing a fuel moving distance along an air jet axis from the second air introduction hole 16 by a radius of the combustor liner 3, and a vertical axis corresponds to a value obtained by standardizing the fuel attainment distance from the second fuel nozzle by the radius of the second air introduction hole 16.

In the combustor 1 in accordance with the present embodiment, the injection angle of the second fuel nozzle 17 is selected to 35 degree in such a manner that the fuel reaches an outer edge of the air jet from the second air introduction hole 16, at a time of moving forward to the center portion in the diametrical direction of the combustor liner 3 along the air jet axis from the second air introduction hole 16.

In general, in the regeneration type gas turbine, since the inlet air temperature of the combustor is high, but the combustion gas temperature in the outlet of the combustor (the inlet of the gas turbine) is comparatively low, and the temperature increase in the combustor becomes smaller, there is obtained a specification which has a small equivalent ratio in the whole of the combustor and is harsh on the blow-off of the frame. In the regeneration type gas turbine to which the combustor shown in the present embodiment is applied, in particular, since a regenerating efficiency is high, and the combustion gas temperature in the outlet of the combustor is extremely lower in comparison with the general industrial gas turbine in spite that the air temperature in the inlet of the combustor is high, the air is excess, and the blow-off tends to be generated. Accordingly, the cross sectional average combustion gas flow speed in the outlet of the combustor is set to 28 m/s which is lower than that of the normal gas turbine. In the case of putting the combustor in accordance with the present embodiment to practical use, in view of preventing the blow-off, and securing the combustion efficiency, it is desirable to set the average combustion gas flow speed in the cross section of the outlet of the combustor to 20 to 50 m/s so as to design slower in comparison with the combustion gas flow speed 40 to 70 m/s in the outlet of the normal combustor.

Next, a description will be given of a second embodiment of the combustor for the gas turbine in accordance with the present invention on the basis of the combustor for the back flow can type regeneration gas turbine shown in FIG. 5.

The regeneration type gas turbine to which the combustor 1 in accordance with the present embodiment is applied corresponds to a combustor having a specification that the air temperature in the inlet of the combustor 1 is 654° C., the average combustion gas temperature in the outlet cross section is 960° C., and the city gas "13A" is used as the fuel. Further, Table 2 shows a combustion gas average flow speed in an outlet cross section of the combustor, an equivalent ratio in a whole of the combustor and an allocation of the air and the fuel in the present embodiment. Further, the combustor corresponds to the combustor for the regeneration type gas turbine which is suitable for generating a comparatively small capacity of power while being a little larger than the combustor in accordance with the first embodiment.

TABLE 2

| No. | item | unit | numerical value |
|---|---|---|---|
| 1 | outlet average flow speed | m/s | 28.0 |
| 2 | combustor whole equivalent ratio | — | 0.133 |
| 3 | combustor inlet air temperature | ° C. | 654 |
| 4 | combustor liner opening area rate | % | 20 |
| 5 | primary air ratio | % | 4 |
| 6 | secondary air ratio | % | 9 |
| 7 | third air ratio | % | 19 |
| 8 | cooling air ratio | % | 30 |
| 9 | dilution air ratio | % | 39 |
| 10 | primary fuel ratio | % | 13 |
| 11 | secondary fuel ratio | % | 29 |
| 12 | third furl ratio | % | 58 |
| 13 | pilot burner equivalent ratio | — | 0.448 |
| 14 | secondary burner equivalent ratio | — | 0.452 |
| 15 | third burner equivalent ratio | — | 0.402 |
| 16 | pilot burner combustion gas temperature | ° C. | 1515 |
| 17 | secondary burner combustion gas temperature | ° C. | 1401 |
| 18 | third burner combustion gas temperature | ° C. | 1575 |
| 19 | secondary burner mixture average temperature | ° C. | 931 |
| 20 | third burner mixture average temperature | ° C. | 961 |

A different portion of the present embodiment from the first embodiment exists in a point that a third burner 19 having the same structure as that of the second burner 8 is provided in a downstream side of the second burner 8 outside the first burner 5 and the second burner 8, for setting the operating range on the basis of the low NOx combustion to a wide range from the 60% load to the rated load. Accordingly, the same reference numerals as those in FIG. 1 denote the same elements, and an overlapping description will be omitted.

Figure 5:
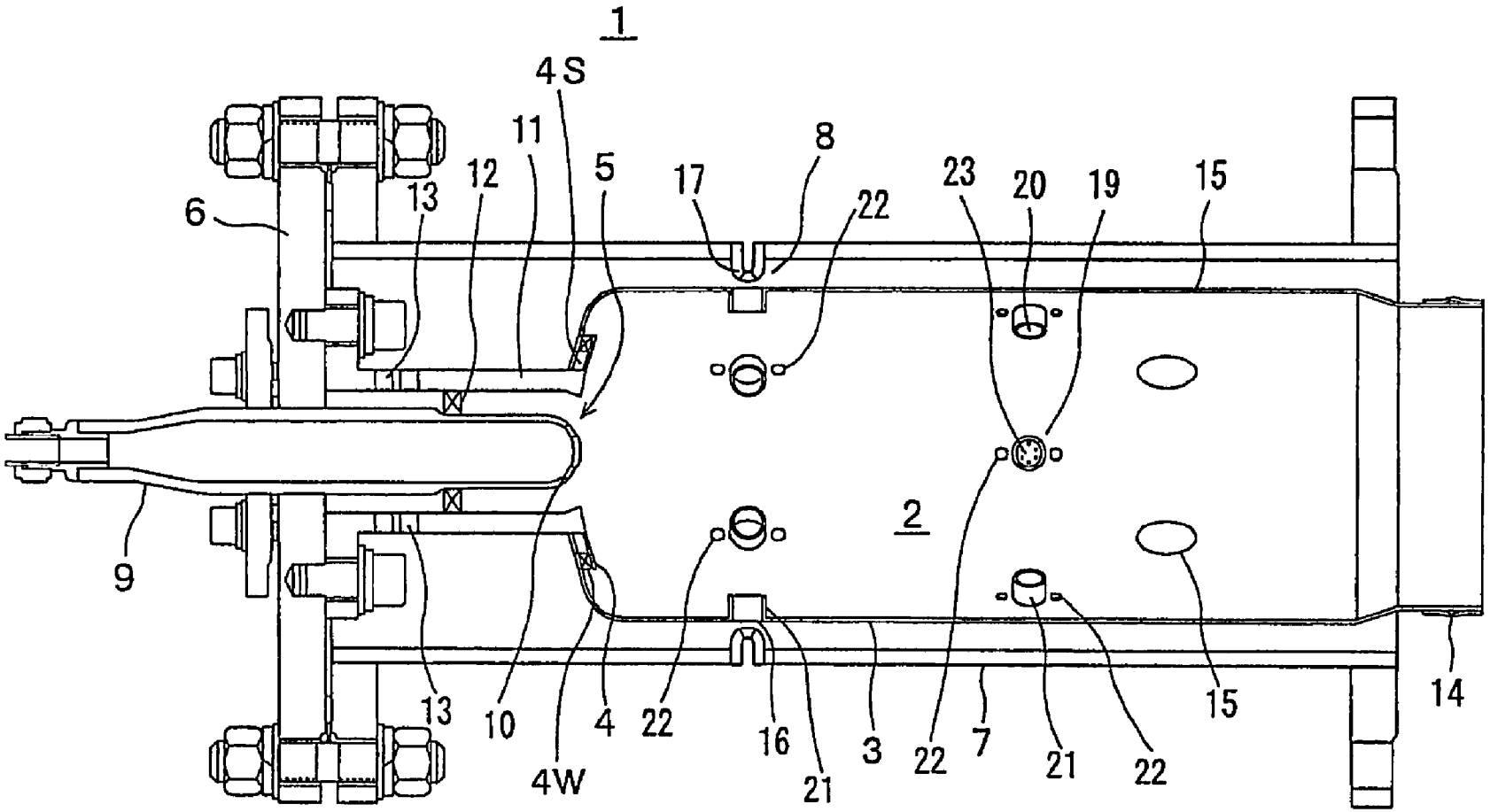
FIG. 5 is a vertical cross sectional side elevational view showing a second embodiment of the combustor for the gas turbine in accordance with the present invention.

The combustor 1 shown in FIG. 5 has the tubular combustor liner 3 forming the combustion chamber 2 and having the circular cross sectional shape, the liner cap 4 closing the upstream side of the combustor liner 3, the first burner 5 formed in the center of the liner cap 4 and constituted by the pilot burner, the end cover 6 provided in the upstream side of the first burner 5, the outer tube 7 in which one end side is fixed to the end cover 6 and the other end side is provided in an extending manner in the outer peripheral portion side of the combustor liner 3 via a gap, and a plurality of second burners 8 formed so as to pass through the peripheral wall of the combustor liner 3, in the same manner as the combustor in FIG. 1, and further has a plurality of third burners formed so as to pass through the peripheral wall of the combustor liner 3 in a downstream side of the second burners 8.

The first burner 5 bears an operation from an ignition to a start and warm-up and a 60% partial load operation, is provided with a swirling passage having the swirling vane 12 with respect to the air introduction tube 11 in the periphery of the first fuel nozzle 9, and is provided with the first air introduction holes 13 communicating with the swirling passage at six positions in a peripheral direction in two lines of the air introduction tube 11. The liner cap 4 is provided with a heat shielding air slot 4S having a swirling vane 4W, for shielding the heat from the first burner 5.

The combustor liner 3 is provided with the dilution hole 15, the spring seal 14 with respect to the transition piece and the second air introduction hole 16 for the second burner 8, and a third air introduction hole 20 for a third burner 19 is formed in a downstream side of the second air introduction hole 16. Further, the second air introduction hole 16 and the third air introduction hole 20 are provided with guide tubes 21 so as to protrude into the combustion chamber 2 in such a manner that the introduced air can reach the center portion in the diametrical direction of the combustor liner 3, and protection air holes 22 are provided near an upstream side and a downstream side so as to prevent the guide holes 21 from being burned out by the combustion gas.

A plurality of second burners 8 are constituted by the second air introduction holes 16 provided at six positions in the peripheral direction of the peripheral wall of the combustor liner 3, and the second fuel nozzles 17 provided so as to pass through the peripheral wall of the outer tubes 7 respectively facing to the second air introduction holes 16. The third burners 19 are constituted by third air introduction holes 20 provided at six positions in the peripheral direction of the peripheral wall of the combustor liner 3, and third fuel nozzles 23 provided so as to pass through the peripheral wall of the outer tubes 7 respectively facing to the third air introduction holes 20.

In the combustor 1 having the structure mentioned above, the combustion air is compressed by the compressor (not shown), and is guided in the left direction in the drawing from the gap between the combustor liner 3 in the right side in the drawing and the outer tube 7, in a state of being heated by the regeneration heat exchanger (not shown). A part of the guided combustion air is introduced into the combustion chamber 2 from the diluting holes 15 provided at six positions in the peripheral direction, the third air introduction holes 20 provided at six positions in the peripheral direction and the second air introduction holes 16 provided at six positions in the peripheral direction, and is further introduced into the combustion chamber 2 from the first air introduction holes 13 provided in two lines at six positions in the peripheral direction via the air introduction tube 11, thereby flowing out to the transition piece.

On the other hand, the fuel is injected into the combustion chamber 2 from the first fuel nozzle 9, the second fuel nozzle 17 and the third fuel nozzle 23. Since all the fuel is directly injected into the combustion chamber 2, and the structure such as the pre-mixed gas mixed with the air in the outer side of the combustion chamber 2 does not exist, the present embodiment is the same as the first embodiment in theory in a point that the trouble such as the self-ignition or the back fire is not generated.

In the first burner 5 shown in the present embodiment, the ignition hole of the first fuel nozzle 9 is set to have a small diameter and is increased in number, and the structure is made such that a half number of the injection holes are provided near the outlet of the air introduction tube 11 so as to promote the mixture between the fuel and the air.

Figure 6:
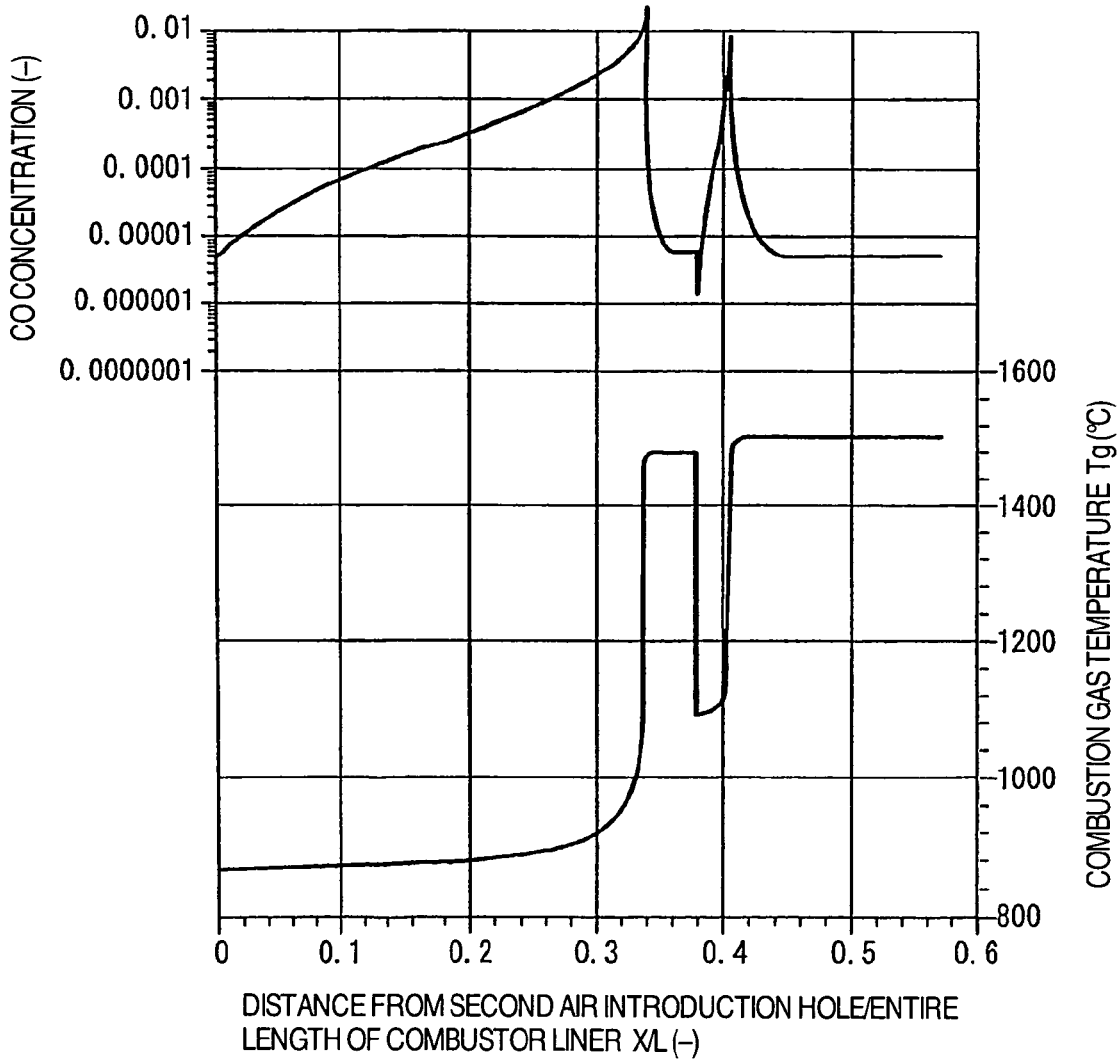
FIG. 6 is a graph showing a change by a reaction calculation of a carbon monoxide concentration and a combustion gas temperature in the combustor for the gas turbine shown in FIG. 5.

FIG. 6 shows a result obtained by executing a chemical reaction simulation with respect to a slow combustion reaction of the lean air-fuel mixture in the combustor 1 in accordance with the present embodiment. In FIG. 6, a horizontal axis corresponds to a distance from the second air introduction hole 16 to the dilution hole 15 standardized by an entire length of the combustor liner 3. A position of the diluting hole 15 exists at 0.60 in the combustor 1 shown in FIG. 1. A lower curve in FIG. 6 shows a change of a combustion gas temperature along a combustion gas circulating direction within the combustor, and an upper curve shows a concentration of a monoxide along the combustion gas circulating direction as an index of the reaction.

The process of the slow combustion reaction of the lean air-fuel mixture is the same as the first embodiment shown in FIG. 2, however, in the present embodiment, since the mixing average temperature is set higher than the first embodiment such that the mixing average temperature is 931° C. about the second burner 8, and it is 961° C. about the third burner 19, a necessary staying time is short and the progress of the reaction is fast. As shown in Table 2 mentioned above, the reaction makes progress faster in spite that the equivalent ratio of the third burner 19 is lower than the second burner 8 because the mixing average temperature becomes higher by the contribution of the heat generation of the fuel of both the first burner 5 and the second burner 8 with respect to the third burner 19.

As mentioned above, since the burner injecting the fuel and the air so as to intersect the downstream side of the flame generated by the first burner 5 is formed in the multi stages such as the second burner 8 and the third burner 19, thereby reducing the mixing flow amount in each of the stages, it is possible to make the mixing average temperature in the burner in each of the stages higher. In addition, since it is possible to utilize the heat generation in the upstream side in the downstream side of the combustion gas, it is possible to achieve a higher mixing average temperature, and it is possible to burn a leaner air-fuel mixture. In this case, it is desirable to arrange the air introduction holes 16 and 20 of the burners 8 and 19 in each of the stages in a zigzag shape in the peripheral direction in order to suppress the deviation of the combustion gas temperature in the outlet of the combustor.

Figure 7:
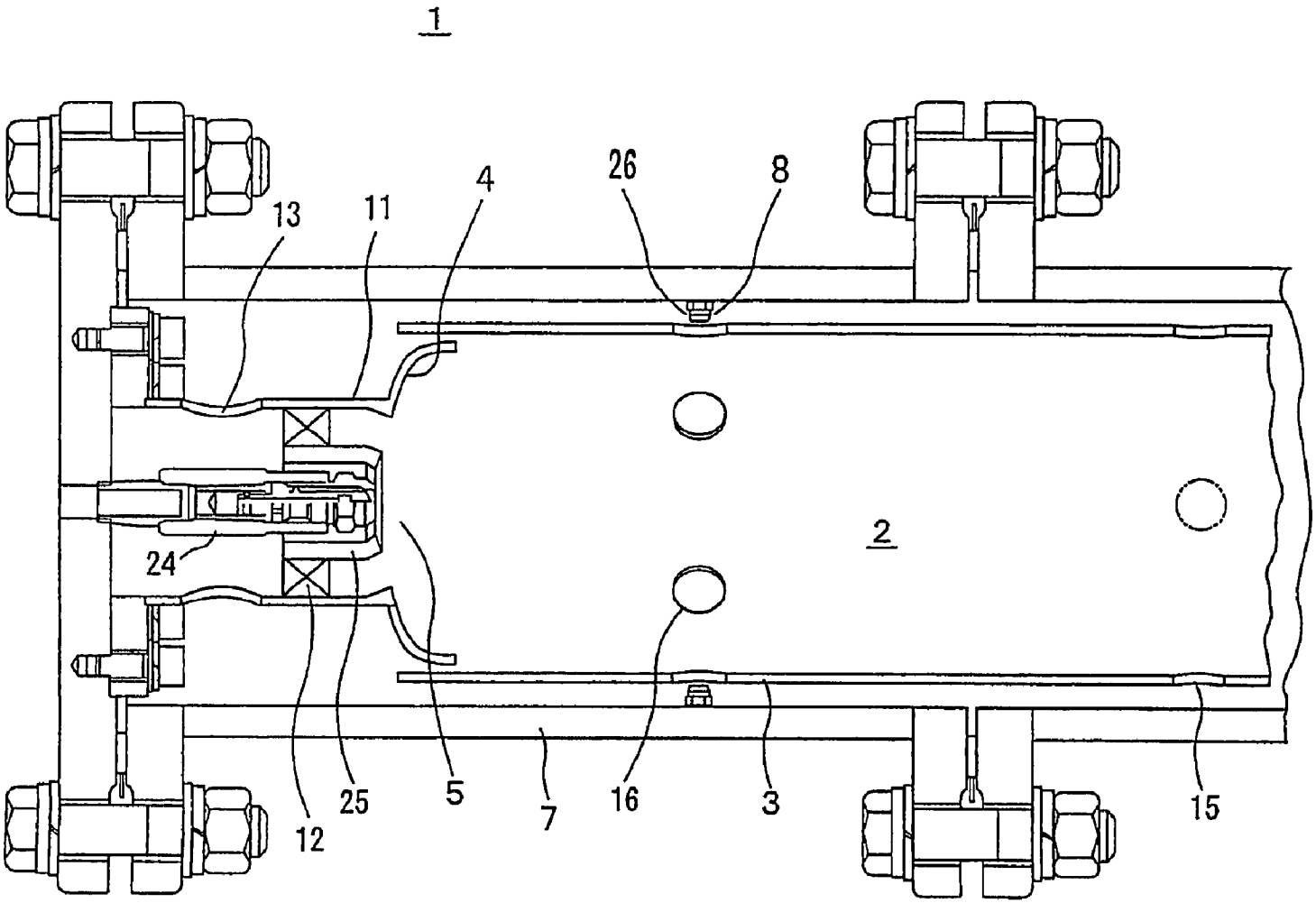
FIG. 7 is a vertical cross sectional side elevational view showing a third embodiment of the combustor for the gas turbine in accordance with the present invention.

A description will be given of a third embodiment in accordance with the present invention with reference to FIG. 7. The combustor 1 shown in FIG. 7 is constituted by the back flow can type combustor in the same manner as the combustor shown in FIGS. 1 and 5. The combustor 1 in accordance with the present embodiment corresponds to the combustor for the regeneration type gas turbine which executes an extremely small-scaled power generation in comparison with the previous two embodiments, and has a specification that the air temperature in the inlet of the combustor is 470° C., the cross sectional average combustion gas temperature in the outlet of the combustor is 860° C., and a lump oil is used as the fuel.

In the present embodiment, since the fuel is constituted by the lump oil corresponding to a liquid fuel, the structure of the combustor 1 and the distribution of the air are almost the same as those of the first embodiment except a point that a flow guide 25 is provided so as to circulate the air around the first fuel nozzle 24 for preventing a calking, and a point that a first fuel nozzle 24 and a second fuel nozzle 26 are structured such as to correspond to the liquid fuel.

Industrial Applicability

As mentioned above, the combustor for the gas turbine in accordance with the present invention is suitably employed for the combustor for the gas turbine in which the air temperature in the inlet of the combustor is high.

The invention claimed is:

1. A combustor comprising:

a tubular combustor liner forming a combustion chamber;

an outer tube provided in an outer peripheral portion side of the combustor liner via a gap;

a first fuel injecting device provided in one end of the combustor liner and having a first fuel spray hole for injecting fuel into the combustion chamber;

a plurality of first air introduction holes upstream of the first fuel spray hole, each first air introduction hole introducing the air through the gap into the combustion chamber;

a plurality of second air introduction holes, each second air introduction hole having a guide tube extending from an inner wall of the tubular combustor liner into the combustion chamber; and a plurality of second fuel injecting devices provided in the outer tube at a position facing a respective second air introduction hole of the plurality of second air introduction holes, and each second fuel injecting device directly injecting the fuel into the combustion chamber through an inlet of the respective second air introduction hole, wherein gas is used as the fuel, and each of the plurality of second fuel injecting devices has a fuel injection nozzle having an injection angle such that the fuel reaches an outer edge of an air jet from the respective second air introduction hole when the fuel goes to a center portion in a diametrical direction of the combustor liner along an air jet axis from said second air introduction hole, and wherein each of the plurality of second air introduction holes and each of the plurality of second fuel injecting devices, respectively, are installed at respective positions so as to inject the air and the gas fuel to a downstream side of a flame generated by the first fuel injecting device.

2. A combustor according to claim 1, wherein the plurality of second fuel injecting devices are arranged such that the fuel and the air come into collision with each other near a center portion of the combustion chamber.

3. A combustor according to claim 1, wherein the guide tube guides the fuel and the air to a center portion of the combustion chamber.

4. A combustor according to claim 1, wherein a third fuel injecting device generating a circulation jet flow of an air-fuel mixture is provided near a terminal end portion of a reaction region within the combustion chamber.

* * * * *